US005996578A

United States Patent [19]

MacGregor

[11] Patent Number: 5,996,578

[45] Date of Patent: Dec. 7, 1999

[54] UNDERWATER BREATHING APPARATUS AND AIR COMPRESSOR

[76] Inventor: Bruce MacGregor, 55 Roosevelt Cir., Palo Alto, Calif. 94306

[21] Appl. No.: 08/991,089

[22] Filed: Dec. 15, 1997

Related U.S. Application Data

[60] Provisional application No. 60/033,014, Dec. 16, 1996.

[51] Int. Cl.[6] ..... A62B 7/00

[52] U.S. Cl. ..... 128/204.26; 128/201.27; 128/205.22

[58] Field of Search ..... 128/204.26, 205.15, 128/205.22, 202.14, 201.11, 201.27, 204.18

[56] References Cited

U.S. PATENT DOCUMENTS

| | | | |
|---|---|---|---|
| 2,456,130 | 12/1948 | Lambertsen | 128/205.22 |
| 3,934,581 | 1/1976 | O'Neill | 128/205.22 |
| 4,051,846 | 10/1977 | McClure, III | 128/205.22 |
| 4,054,132 | 10/1977 | Deeds | 128/205.22 |
| 4,068,657 | 1/1978 | Kobzan | 128/205.22 |
| 4,245,632 | 1/1981 | Houston | 128/201.11 |
| 5,297,545 | 3/1994 | Infante | 128/204.18 |
| 5,327,849 | 7/1994 | Miller | 128/202.14 |

*Primary Examiner*—John G. Weiss
*Assistant Examiner*—V. Srivastava
*Attorney, Agent, or Firm*—Gregory Scott Smith

[57] ABSTRACT

A short term underwater breathing device including one or more housings containing a compressor powered by a battery for pumping air from an air intake valve through an air filter and dryer into a storage reservoir. The user draws air from the storage reservoir through a demand regulator. An electronic controller regulates the compressor, controls the opening and closing of the air intake valve, and monitors the air storage reservoir pressure. In a preferred embodiment the compressor, the battery, the air filter and dryer, and the controller are contained within a water tight compartment of a housing, which housing is preferably worn by the user. When the user is on the surface, the air intake valve opens and the battery provides power to the air compressor which draws the air through the filter and the dryer into the air storage reservoir. When submerged, the air intake valve closes, the compressor stops, and the user breaths the air from the storage reservoir through the regulator. The reservoir can provide several minutes of air to the user while under water.

20 Claims, 7 Drawing Sheets

UNDERWATER BREATHING APPARATUS AND AIR COMPRESSOR

CROSS REFERENCE TO RELATED APPLICATIONS

This application claims the benefit of the provisional patent application of Bruce MacGregor, for an Underwater Breathing Apparatus with Compressor, Ser. No. 60/033014, filed on Dec. 16, 1996, which application is hereby incorporated by reference in its entirety.

FIELD OF THE INVENTION

The present invention relates to underwater breathing apparatus, specifically, an underwater breathing apparatus which includes a compressor and air storage reservoir, and which is carried by the diver or user.

DESCRIPTION OF THE PRIOR ART

Many devices have been invented to allow swimmers to breathe underwater for a period of time. The simplest of these devices is the conventional snorkel, which comprises a tube that extends from the swimmer's mouth to the water's surface. Use of conventional snorkels has been rising. However, one disadvantage of snorkels is the limited depth that the swimmer can achieve while breathing through conventional snorkels.

Motorized snorkels using compressors to pump air to divers were developed to overcome some problems encountered by conventional snorkels. Most such prior art devices pump ambient air, from an inlet located on a floating device on the water's surface, down a length of tubing to a mouthpiece from which the user may breath. Such apparatus are described in U.S. Pat. Nos. 4,245,632, issued to Houston, 4,674,493, issued to Mitchell, 4,832,013, issued to Hartdom, 5,297,545, issued to Infante, and 5,327,849, issued to Miller. However, the user is limited in mobility by the length of tubing, which may also be subject to entanglement, and which decreases the portability of the device. Additionally, none of the prior art described thus far include means for removing potentially harmful particulate matter and water vapor from the air provided to the user.

Self-contained underwater breathing apparatus (SCUBA) overcome many disadvantages inherent in the devices describe above, however, SCUBA apparatuses are relatively expensive and complicated, and the air tanks used by the devices must usually be brought to specialized refilling stations to be refilled with pressurized air.

What is needed is an underwater breathing apparatus which overcomes the disadvantages of the prior art.

SUMMARY OF THE INVENTION

Accordingly, the present invention is an underwater breathing apparatus that includes one or more housing means for housing an air intake means for taking in ambient air, coupled to a compressor means for compressing the ambient air, which is in turn coupled to an air storage means for storing the compressed air, coupled to a mouth piece means through which the diver breaths. The housing further contains a power source means for providing power to the compressor means, and to a control circuit means for controlling some of the various functions of the present invention.

In use, when the user is at the surface of the water, the compressor means is activated by the control circuit means to draw air through the air intake means into the air storage means so that user is able to breath from the air stored in the air storage means through the mouthpiece means.

In various embodiments, the mouth piece is preferably a demand regulator, the compressor is preferably a diaphragm or oil-less piston compressor, the underwater breathing apparatus further includes air filter means and air drying means, the air intake means includes a valve means for opening and closing the air intake means. In additional embodiments, the underwater breathing apparatus further comprises means for strapping the underwater breathing apparatus to a users back, or, in an alternate embodiment the underwater breathing apparatus is coupled to a diver propulsion vehicle, and the underwater breathing apparatus housing includes a wet section open to ambient water and a dry section containing the compressor, the battery, and the control circuit.

Many advantages of the underwater breathing apparatus of the present invention will no doubt occur to those skilled in the art from reading and understanding the following detailed description along with the accompanying drawings.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DETAILED DESCRIPTION OF THE INVENTION

The following description is provided to enable any person skilled in the art to make and use the invention and sets forth the best modes presently contemplated by the inventor of carrying out his invention. Various modifications, however, will remain readily apparent to those skilled in the art, as generic principles of the present invention have been defined herein.

Figure 1:
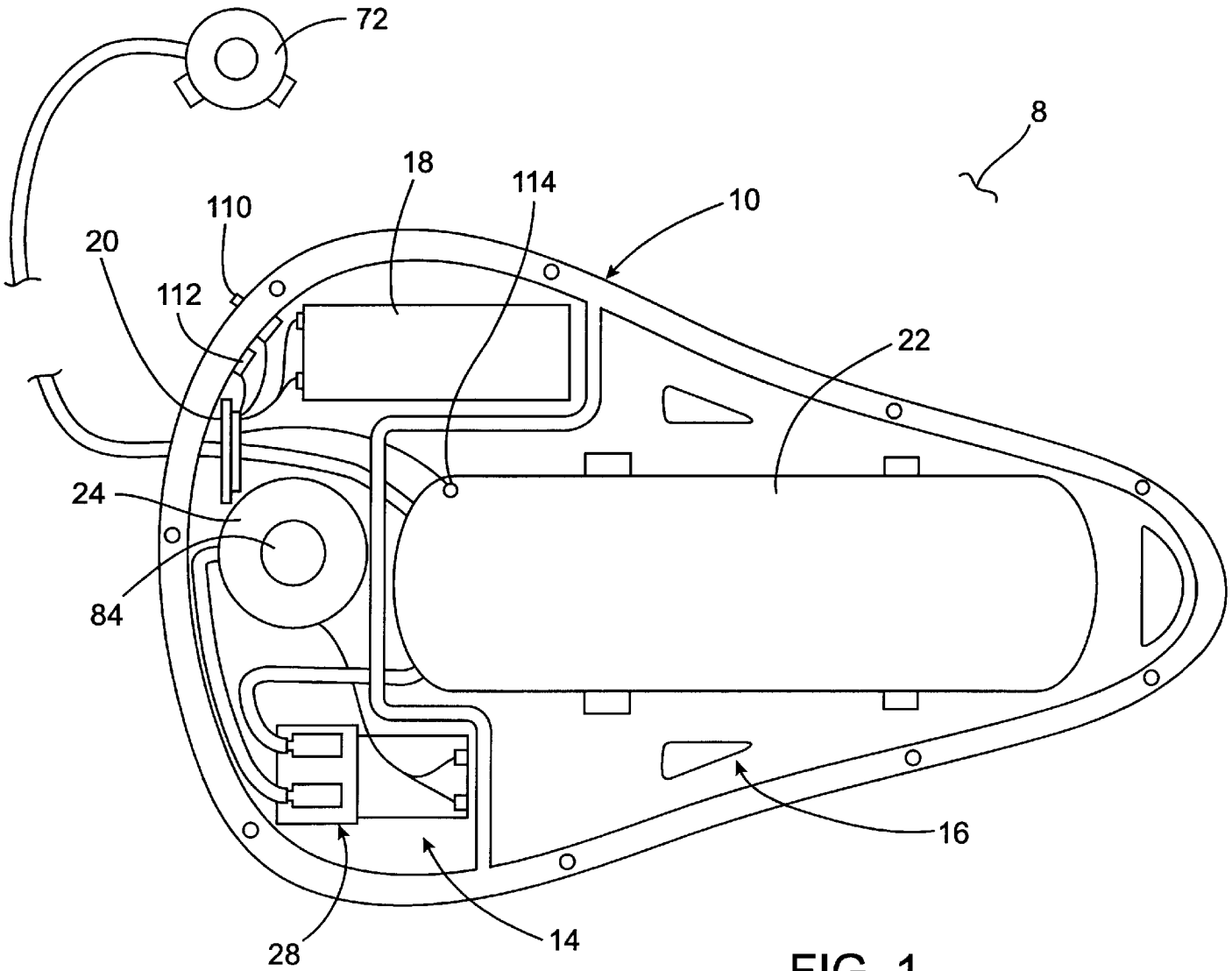
FIG. 1 shows a top view of the breathing apparatus of the present invention with the housing cover removed.

Referring now to the drawings wherein like reference numerals designate identical or corresponding parts or portions throughout the several views, and in particular to FIG. 1, the present invention is an underwater breathing apparatus, generally designated by the number 8, carried by a diver or user contained within a streamlined housing that is worn on the user's back. However, in alternate embodiments the device could be worn elsewhere on the diver, or could be instead incorporated into a small diver propulsion vehicle or other underwater propulsion device.

The underwater breathing apparatus includes a housing 10, shown with a housing cover 12 removed, showing the preferred configuration of the some of the major components of the present invention, comprising a battery 18, a control circuit 20, an air storage reservoir 22, an air filter and dryer 24, an air intake assembly 26, a compressor 28, and various connecting hoses and wires, which components will be described in more detail below. The user breaths from the air in the air storage reservoir 22. When the user is swimming at the surface, the compressor 28 draws ambient air through the air intake assembly 26 and stores the air in the storage reservoir 22.

Figure 2:
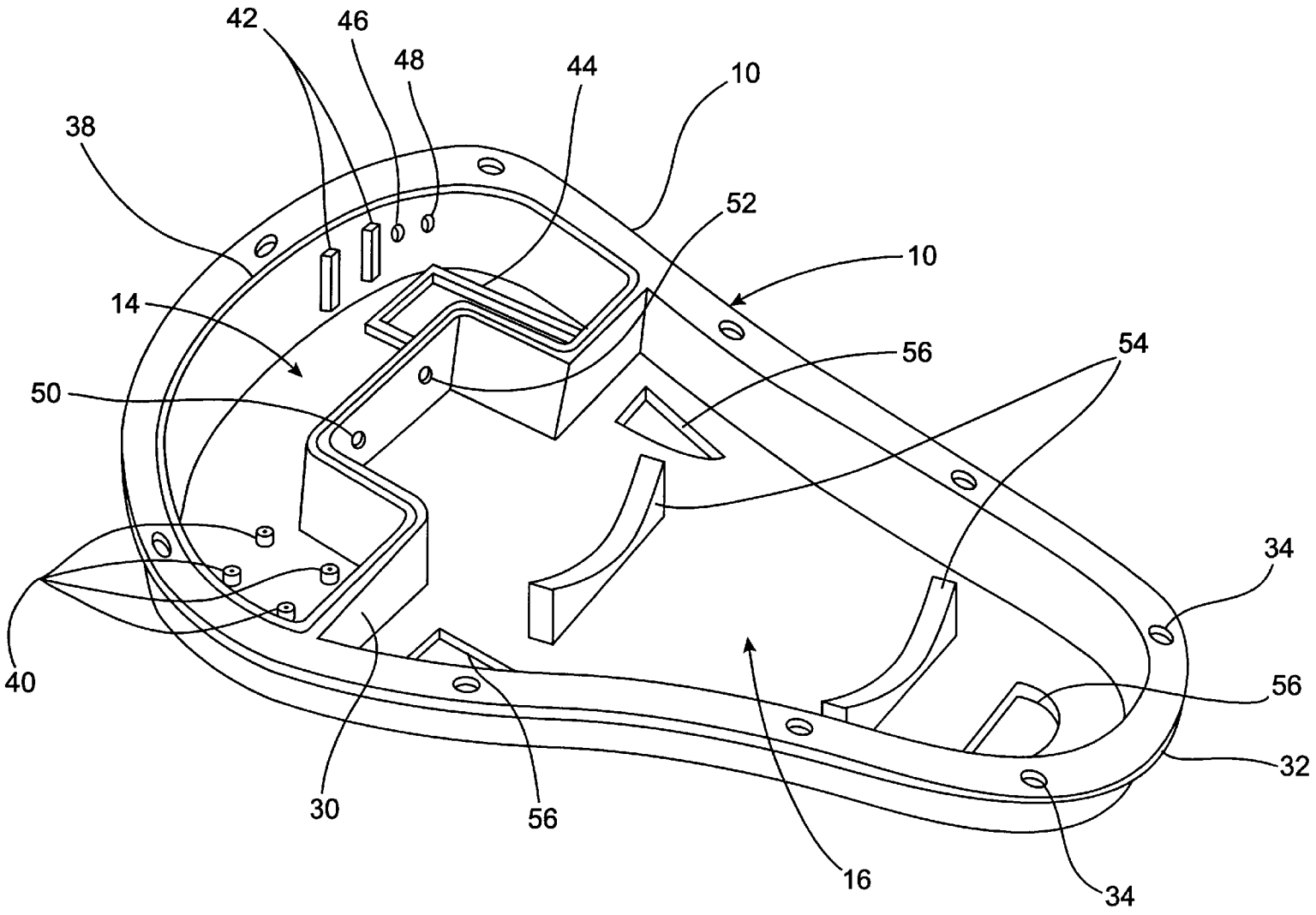
FIG. 2 shows a perspective view of a preferred embodiment of the housing of FIG. 1 with the housing cover removed.
Figure 3:
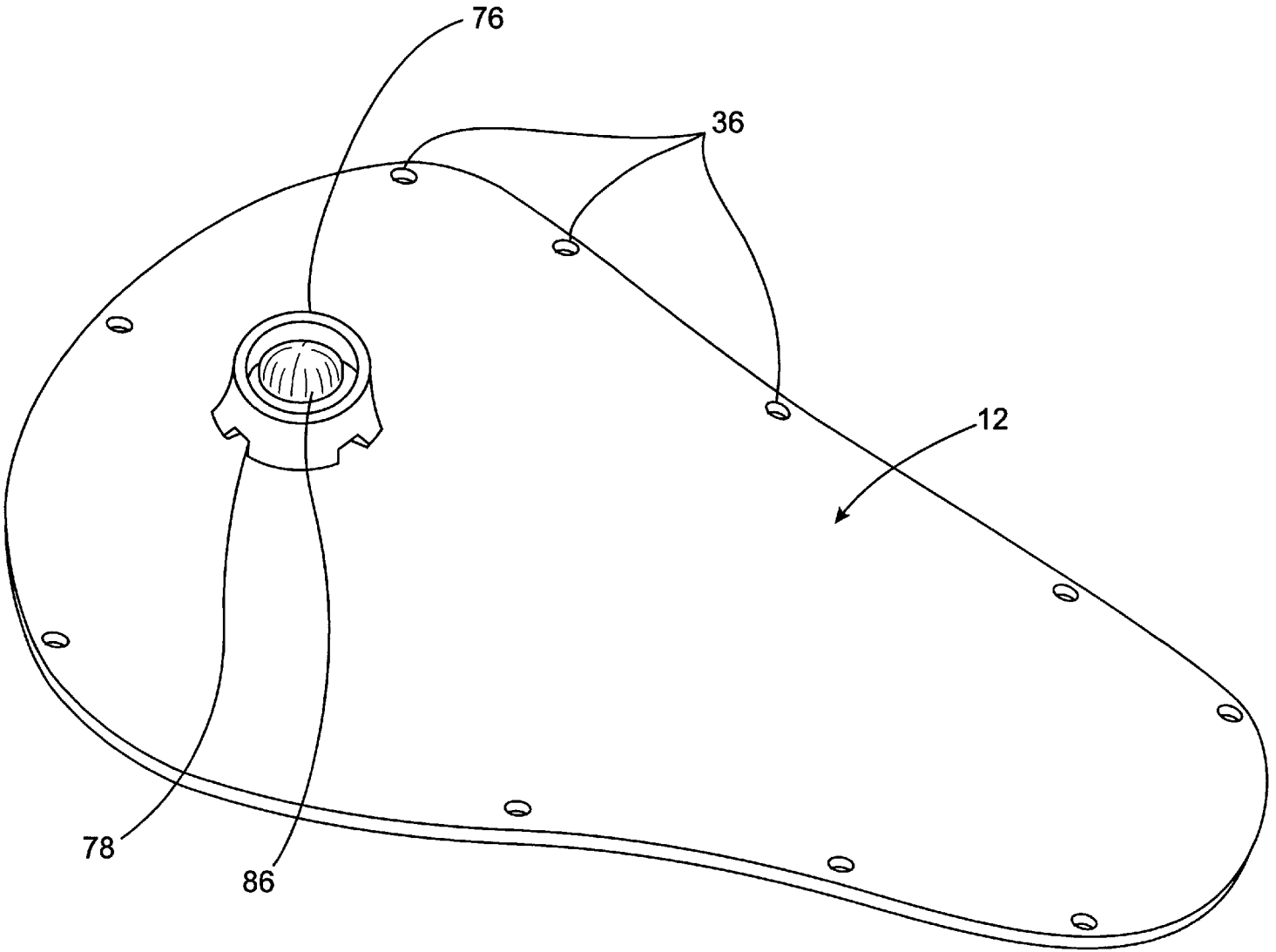
FIG. 3 shows a perspective view of the housing cover of the present invention.

Referring to FIG. 2, the housing is preferably formed of a lightweight material, such as Polyethylene or ABS (Acrylonitrile Butadiene Styrene), styrene or polypropylene, which are resistant to water, salt water and ultra violet light, or have been treated to be thus resistant. In the preferred embodiment shown, the housing 10 is subdivided into a dry compartment 14, and a wet compartment 16 divide by dividing wall 30. The housing 10 includes a flange 32 around the periphery of the housing 10. In the preferred embodiment shown, a plurality of flange through holes 34 are formed in the flange 32. Corresponding housing cover through holes 36 are formed in the housing cover 12 (seen in FIG. 3). To close the housing 10, the housing cover 12 is placed onto the housing 10 and the flange through holes 34 and housing cover through holes 36 are aligned. Flange bolts, not shown, not shown, are inserted through the aligned through holes 34,36 and are threadably coupled with nuts. The seal between the housing 10 and the housing cover 12, and the housing cover 12 and the dividing wall 30 is water tight, thus preventing water form entering the dry compartment 14. A gasket 38 comprised of elastomeric material is positioned on the portion of the housing 10 forming walls of the dry compartment 14, and on the dividing wall 30 to provide additional protection against the entry of water into the dry compartment 14 when the housing cover 12 is coupled to the housing 10. In alternate embodiments, other known means for coupling the housing cover 12 to the housing 10 may be used including clamps and buckles, or the like.

Figure 5:
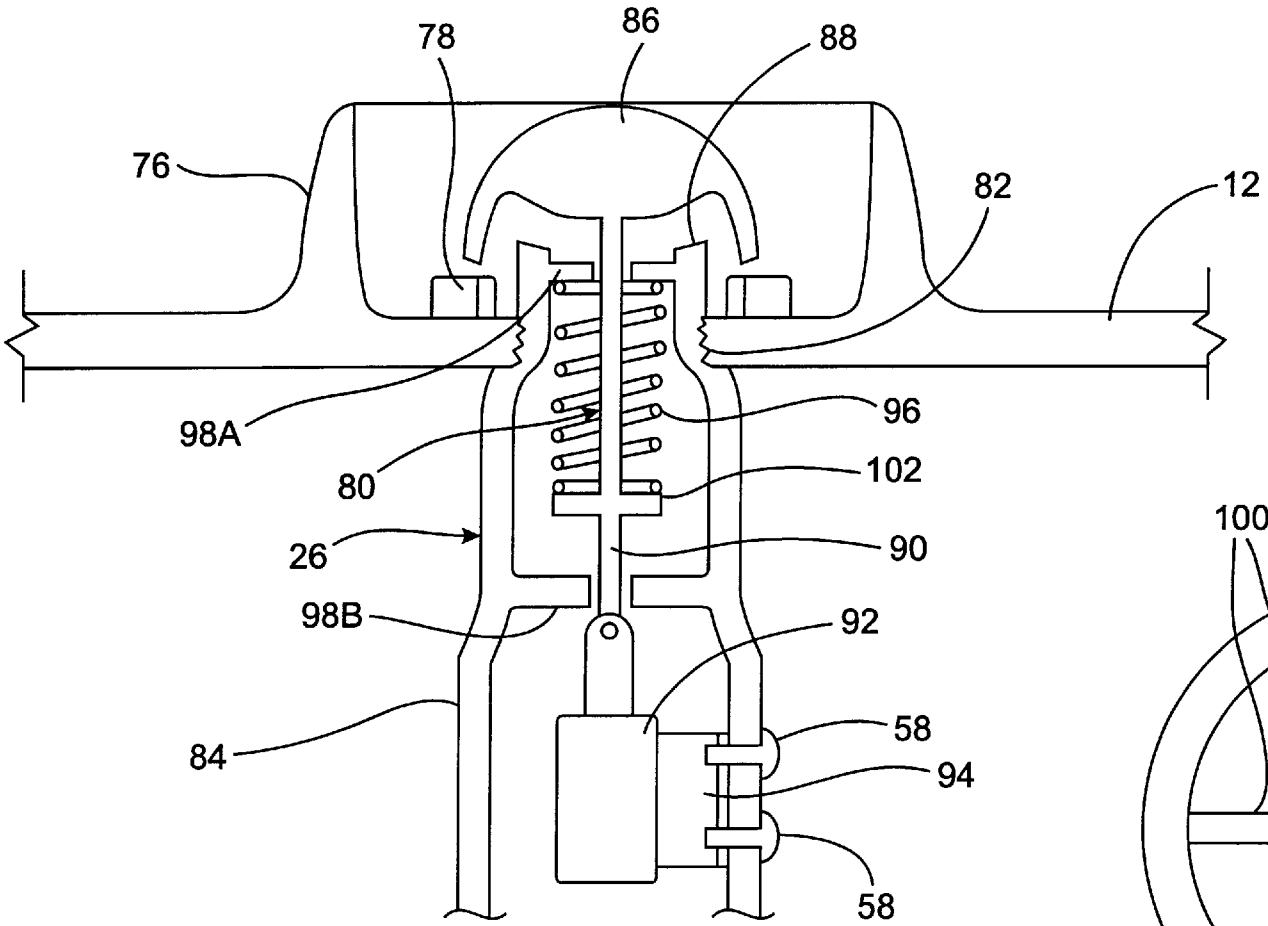
FIG. 5 shows a cross section of the intake assembly of the underwater breathing apparatus of FIG. 1.

The housing cover 12 further includes an air intake aperture 82 and shroud 76 of the air intake assembly 26, best seen in FIG. 5. The air intake assembly 26 includes an air intake tube 84 which is coupled to the housing cover 12 at a first end, and extends from the housing cover 12 to the filter and dryer 24.

The dry compartment 14 is preferably sealed against the entry of water to a depth of at least 60 feet, and includes means for mounting the battery 18, the compressor 28, the air filter and dryer 24, and the control circuit 20. Any known means for removably mounting the battery 18, the compressor 28, the air filter and dryer 24, and the control circuit 20 may be used. However, in the preferred embodiment shown, a plurality of cylindrical compressor vibration mounts 40 are provided for mounting the compressor 28 within the dry compartment 14 of the housing 10, rectangular control circuit mounts 42 are provided for mounting the control circuit 20, and a battery mount 44 is provided for removably holding the battery 18. The compressor mounts 40, the control circuit mounts 42, and the battery mount 44, are preferably formed integrally with the housing 10, but in alternate embodiments could be separate pieces affixed to the housing 10. The housing 10 further includes recharge port 46 and a switch aperture 48. The dividing wall 30 of the housing 10 further includes a high pressure tube aperture 50 and a demand regulator tube aperture 52.

The wet compartment 16 is preferably formed with support brackets 54 to partially receive the air storage reservoir 22 to prevent the air storage reservoir 22 from moving within the wet compartment. The wet compartment 16 is open to the ambient water through a plurality of vents 56 which allow water to flow in and out of the wet compartment 16. Allowing water to enter the wet compartment 16 of the housing 10 is preferred to reduce the buoyancy of the underwater breathing apparatus 8 of the present invention, thereby reducing the amount of compensating weight that may otherwise be needed to achieve neutral buoyancy. However, in alternate embodiments, the wet compartment 16 could be water tight. The underwater breathing apparatus 8 is preferably adjusted to be neutrally buoyant at a depth of approximately 20 feet. In the preferred embodiment shown, three vents 56 are provided in the housing 10, however, in alternate embodiments, any number of vents of any may be used, and vents may also be provided on the housing cover 12.

Figure 4:
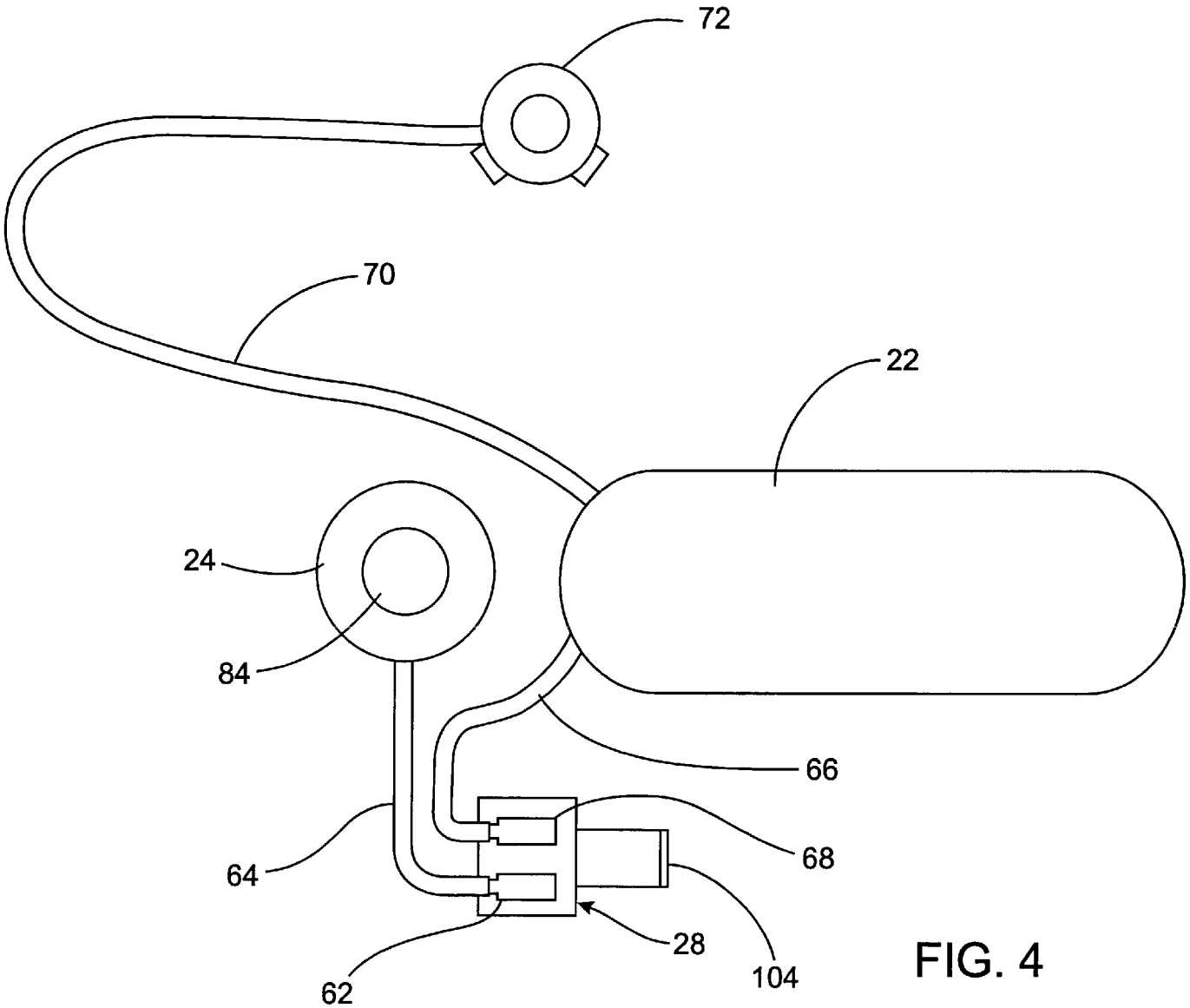
FIG. 4 shows a shows the air flow system of the underwater breathing apparatus of FIG. 1 in isolation.

FIG. 4 shows the air flow system comprising the air intake assembly 26, which is coupled to the air filter and dryer 24, which is coupled to the ambient air intake 62 of the compressor 28 by a low pressure connecting hose 64. The compressor 28 is coupled to the air storage reservoir 22 by a high pressure connecting hose 66 connecting between the high pressure outlet 68 of the compressor 28 and the air storage reservoir 22. The air storage reservoir 22 is further coupled to a mouthpiece means such as the demand regulator 72 by a demand regulator hose 70.

The air intake assembly 26 is intended, when the user is at the surface of the water, to allow the intake of ambient air and storage of air under pressure in the air storage reservoir 22, while preventing significant amount of water from entering the air flow system. In the preferred embodiment seen in FIG. 5, the air intake assembly 26 comprises elements both above and below the housing cover 12. The upper surface of the housing cover includes an air intake aperture 82 surrounded by a shroud 76 which is preferably formed integrally with the housing cover 12, with a plurality of drain holes 78 around the base of the shroud 76 to allow water to drain away from the air intake aperture 82. In alternate embodiments, the valve mating shoulder 88 could be longer than that shown in FIG. 5, or the shroud could be taller or dispensed with altogether.

An air intake tube 84 is threadably received within the air intake aperture and extends below the underside of the housing cover 12, but with 82 with mating shoulder 88 extending a distance, preferably approximately 3 inches, above the surface of the housing cover 12. A valve assembly 80. In alternate embodiments, other means for mounting the air intake tube 84 to the housing cover 12 could be used, including adhesives.

The valve assembly 80 extends through the air intake tube 84 and includes valve cap 86 which is formed to seat against the mating shoulder 88 of the air intake tube 84 protruding above the housing cover 12. The valve cap 86 is semi-spherical in the preferred embodiment. However, in alternate embodiments the valve cap could be any practical shape. The valve cap 86 is coupled to a first end of a valve stem 90. The valve stem 90 includes a spring shoulder 102 and is coupled in the preferred embodiment to a valve control means at a second end, such as the solenoid 92 seen in FIG. 5. The solenoid 92 is coupled to a solenoid mounting bracket 94 that is coupled to an interior wall of the intake tube 84 by solenoid bracket screws 58. In alternate embodiments other means for mounting the solenoid bracket 94 could be used, including adhesives.

Figure 6:
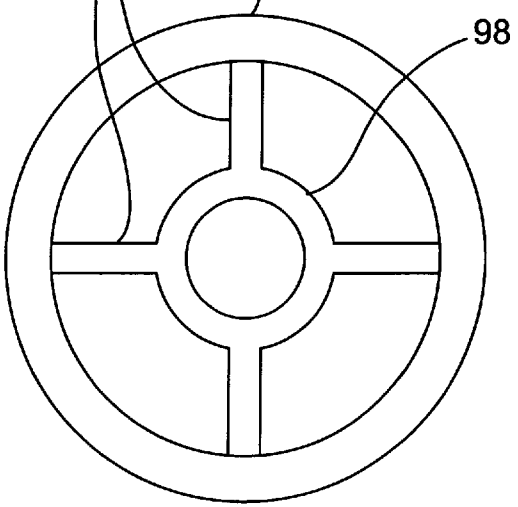
FIG. 6 shows a top view of the circular valve guide and support spokes of FIG. 5.

The valve stem extends through first or upper circular valve guide 98A and second or lower circular valve guides 98B supported in the air intake tube by support spokes 100. A cross section of a circular valve guide 98 and support spokes 100 is seen in FIG. 6. A helical compression spring 96 is disposed around the valve stem 90 having one end contacting the upper guide ring 98A, and a second end contacting the spring shoulder 102 of the valve stem 90.

The valve assembly 80 may be manually activated by the user when the user is at the surface. Alternatively, the air intake assembly 26 may include sensors to detect the presence of water; activating the valve assembly 80 to open when no or very little water is present. In use, the helical compression spring 96 will tend to urge the valve stem 90 downward, pulling the valve cap 86 against the mating shoulder 88 of the air intake tube 84, thereby closing the valve assembly 80 preventing water form entering the air intake assembly 26. When the solenoid 92 is activated, the solenoid 92 urges the valve stem upward against the helical compression spring 96, causing the valve cap 86 to rise above the mating shoulder 88, thereby allowing air to enter the air intake assembly 26. In alternate embodiments, a gas permeable but water impermeable or resistance membrane, such as GOR-TEX®, may be placed over the shroud or over the air intake aperture to further inhibit water from entering the air intake assembly 26.

The preferred air intake assembly 26 of the present invention has been described, however, other known alternative air intake valve types or systems may be used, for example, a cage and ball valve system, buoyant float and lever valve system, solenoid valves different from the system disclosed herein, manual valves, pinch valves, and manually activated valves.

The air dryer means of the air filter and dryer 24 is preferably a desiccant such as silica, however, in alternate embodiments, any known means for drying air can be used. Any known standard filter can be used for the air filter means of the air filter and dryer 24, including various fiber filters, carbon filters and activated charcoal. The air filter means and air dryer means of the air filter and dryer 24 are preferably disposable, however, in alternate embodiments, the air filter means and air dryer means could be reusable. In the preferred embodiment, the air filter means and air drying means of the air filter and dryer 24 are both contained within a single housing, however, in alternate embodiments the air filter means and the air dryer means could be contained within separate housings.

Figure 7:
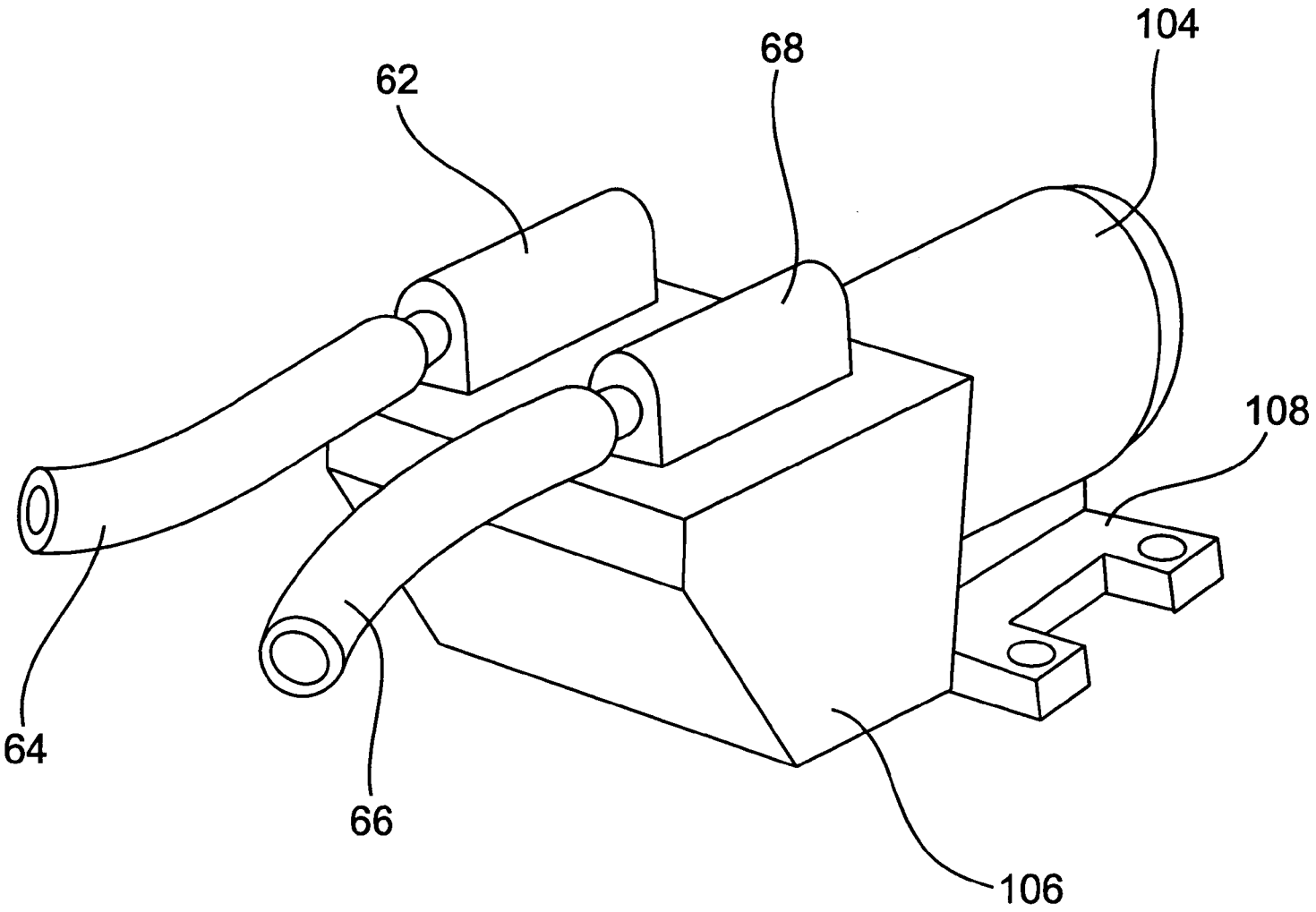
FIG. 7 shows a perspective view of the pump assembly.
Figure 8:
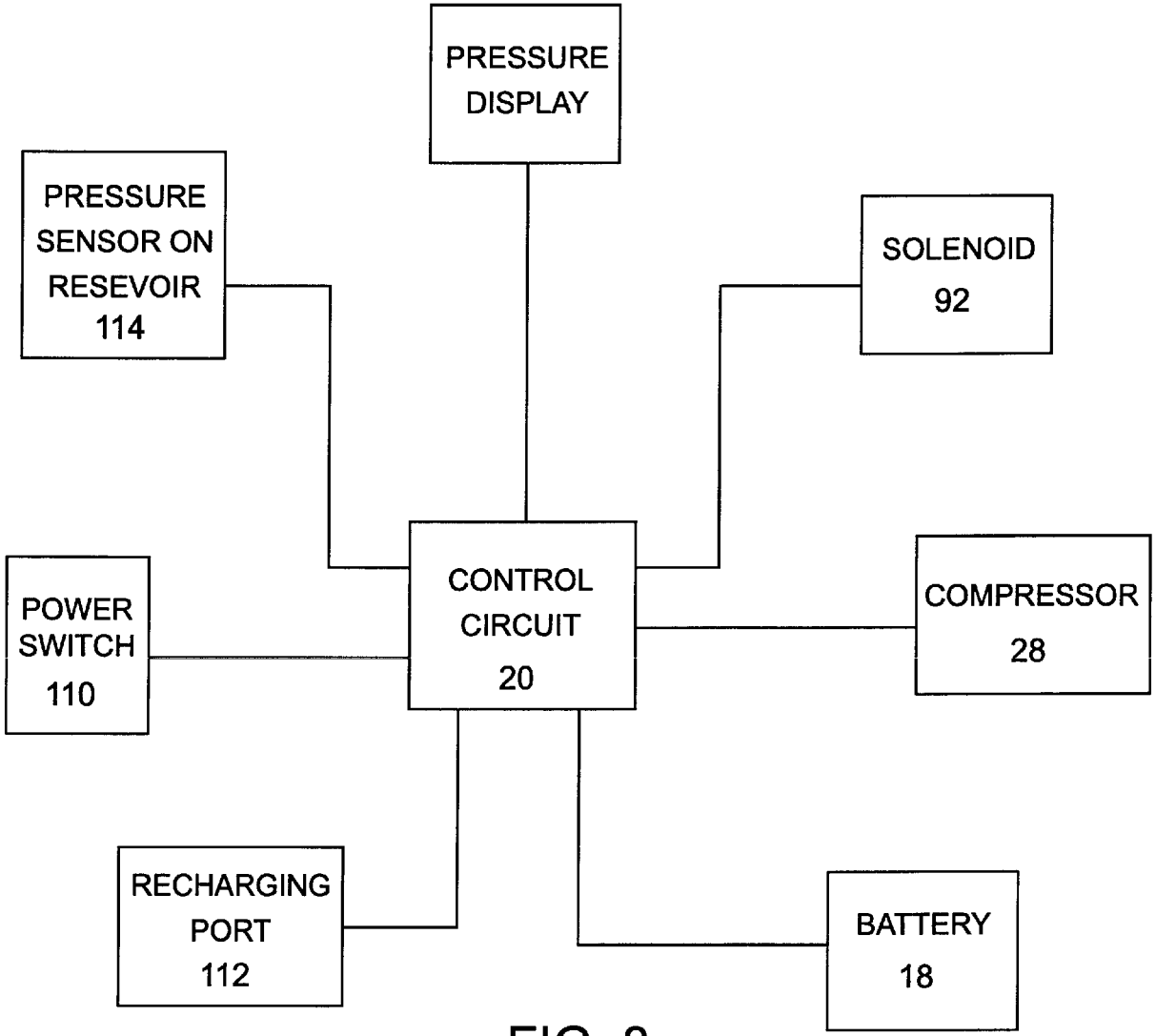
FIG. 8 shows a block diagram of the control circuit.

Referring to FIG. 7, the compressor 28 includes an electric motor 104 coupled to a pump 106 and to a mounting bracket 108. The pump 106 includes an ambient air intake 62 and a high pressure outlet 68. The high pressure outlet 68 is coupled to a first end of a high pressure connecting hose 66, which high pressure connecting hose 66 passes through the high pressure aperture 50 of the dividing wall 30 of housing 10 and is coupled at its second end to the air storage reservoir 22. The ambient air intake 62 is coupled to the low pressure connecting hose 64 coupled to the air filter and dryer 24. Mounting bracket 108 of compressor 28 is coupled to the cylindrical compressor vibration mounts 40 in the dry compartment 14 of the housing 10. The compressor 28 preferably uses a current between 24-volts and 6-volts, and is most preferably a 12-volt DC powered compressor. The compressor 28 is preferably an oil-less piston or diaphragm type compressor, however, any desirable compressor could be including blower type compressor. Any compressor chosen should preferably have a volume output of at least 0.25 cu. ft. per minute to 1.0 cu. ft. per minute, and most preferably 0.5 cu. ft. per minute, at a minimum pressure of 100 psi.

The compressor 28 draws ambient air through the air intake assembly 26 and sends pressurized air through the high pressure outlet 68 and the high pressure connecting hose 66 to the air storage reservoir 22. The air storage reservoir is preferably a cylindrical tank with spherical ends, made from structural plastic such as PVC (polyvinyl chloride), ABS or metals such as aluminum or stainless steel.

The air storage reservoir 22 is coupled to a demand regulator 72 by the demand regulator hose 70. Any standard SCUBA demand regulator capable of being tuned for the relatively low operational pressure of the present invention may be used for the demand regulator 72.

The electrical system can best be seen in FIGS. 1 and 7, and comprises the battery 18, electrically coupled to the control circuit 20, which is electrically coupled to the control switch 110, the recharge outlet 112, the compressor 28, the pressure gage 114 on the air storage reservoir 22, and in alternate embodiments, to any other electrical devices or sensors which may be incorporated into the device but are not shown.

The battery 18 is preferably a sealed rechargeable lead acid battery, however, any useable battery that produces sufficient current to power the compressor 28 could be used, including batteries nickel cadmium batteries, nickel metal hydride batteries, lithium ion batteries. In alternate embodiments, the battery may be replaceable rather than rechargeable. The battery used in the preferred embodiment shown in FIG. 1 preferably has a 80 minute capacity of 6.5 ampere hours amps for compressor operation.

A waterproof switch is conveniently mounted on the housing 10 at switch aperture 48. The switch will preferably have settings for "on," "off," and "recharge," although in alternate embodiments, some of the functions such as recharging could be automatically controlled by the control processor.

A recharge outlet 112 is coupled to the recharge port 46. A water tight plug covers the recharge outlet 112 when the underwater breathing apparatus 8 is in use. When the underwater breathing apparatus 8 needs to be recharged, the water tight plug is removed to allow access to the recharge outlet 112. An external transformer and extension cord may be used to convert standard 110 or 220-volt electric current into the proper current for recharging. In alternate embodiments, the transformer could be contained within the dry chamber of the housing.

The control circuit 20 is also coupled to a pressure sensor 114. Any known pressure gage may be used for Pressure sensor 114. The control circuit 20 monitors the pressure sensor 114, and turns off the compressor 28 when the pressure in the air storage reservoir 22 reaches a predetermined level. In alternate embodiments means for manually overriding the control circuit 20 may be provided.

In use, in a preferred embodiment described herein, the underwater breathing apparatus 8 is contained within a streamline housing 10 that is worn on the user's back. When the user is at the surface, the air intake valve assembly 26 is open and ambient air at atmospheric pressure enters the underwater breathing apparatus 8 through the air intake assembly 26. The air is drawn through the air filter and dryer 24 by the compressor to remove potentially harmful particles, and gasses and to remove water vapor to prevent water condensing and collecting in the air storage reservoir 22. The air is then pressurized to, preferably, 100 psi in the air storage reservoir 22. The user breathes from the air storage reservoir 22 through the demand regulator 72. When submerged, the valve assembly 80 closes and the user continues to breath from the air stored in the air storage reservoir 22. With the underwater breathing apparatus 8 configured as described herein in a preferred embodiment, one minute of compressor operation the surface will provide approximately one minute of air for breathing under water, and a maximum of 2 to 3 minutes of air can be stored. Time under water can be extended with controlled. Obviously, in alternate embodiments, changes in the configuration of the underwater breathing apparatus 8 would alter its performance. Furthermore, in alternate embodiments the device could be worn elsewhere on the diver, or could be instead incorporated into a small diver propulsion vehicle or other underwater propulsion device.

Several advantages of the underwater breathing apparatus 8 of the present invention are readily apparent. For example, the underwater breathing apparatus 8 is less expensive, less complicated and safer to use than SCUBA diving apparatus, or diving apparatus which rely on a long snorkel running to the surface. And, the user can remain under water for significantly longer than would be possible with a conventional snorkel alone. When the underwater breathing apparatus 8 is configured as described in a preferred embodiment herein, it is unlikely that a user could remain submerged deep enough and long enough to encounter decompression problems such as decompression sickness.

The preferred embodiments described herein are illustrative only, and although the examples given include many specificities, they are intended as illustrative of only a few possible embodiments of the invention. Other embodiments and modifications will, no doubt, occur to those skilled in the art. For example, in alternate embodiments one or more of the major element could be in separate housings located in various locations on the diver rather than all gathered within a single housing intended to be worn on the users back. Thus, the examples given should only be interpreted as illustrations of some of the preferred embodiments of the invention, and the full scope of the invention should be determined by the appended claims and their legal equivalents.

What is claimed is:

1. An underwater breathing apparatus comprising:

a compressor housing means for housing a compressor, a battery housing means for housing a battery means, an air storage housing means for housing an air storage means, a compressor means received within said compressor housing means, a submersible air intake means for taking in air coupled to said compressor means, an air storage means, capable of storing air under pressure, received within said air storage housing means, said air storage means being coupled to said compressor means, and coupled to a mouth piece means, and a battery means received within said battery housing means, said battery means being electrically coupled to a control circuit, said control circuit being coupled to said compressor, whereby said compressor means is activated by said control circuit to draw air through said air intake means into said air storage means, whereby the user is able to breath the air stored in said air storage means through said mouthpiece means.

2. The underwater breathing apparatus of claim 1, wherein said mouth piece means is a demand regulator.

3. The underwater breathing apparatus of claim 1, wherein said compressor means comprises one of the following a diaphragm compressor, a piston compressor, or a blower type compressor.

4. The underwater breathing apparatus of claim 1, wherein said underwater breathing apparatus comprises means for removeably coupling said underwater breathing apparatus to a users back.

5. The underwater breathing apparatus of claim 1, wherein said underwater breathing apparatus is coupled to a diver propulsion vehicle.

6. The underwater breathing apparatus of claim 1, further comprising an air filter means.

7. The underwater breathing apparatus of claim 1, further comprising an air drying means.

8. The underwater breathing apparatus of claim 1, further comprising a valve means for opening and closing said air intake means.

9. An underwater breathing apparatus comprising:

a housing, a submersible air intake means for taking in air coupled to said housing, a compressor means received within said housing, said compressor means being coupled to said air intake means, an air storage means, capable of storing air under pressure, received within said housing, said air storage means being coupled to said compressor means, and said air storage means being further coupled to a mouth piece means, a battery means received within said housing, said battery means being electrically coupled to a control circuit, said control circuit being coupled to said compressor means, whereby said compressor means is activated by said control circuit to draw air through said air intake means into said air storage means, whereby the user is able to breath the air stored in said air storage means through said mouthpiece means.

10. The underwater breathing apparatus of claim 9, wherein said mouth piece means is a demand regulator.

11. The underwater breathing apparatus of claim 9, wherein said compressor means comprises one of the following a diaphragm compressor, a piston compressor, or a blower type compressor.

12. The underwater breathing apparatus of claim 9, wherein said housing further comprises means for removeably coupling said housing to the user.

13. The underwater breathing apparatus of claim 9, wherein said underwater breathing apparatus is coupled to a diver propulsion vehicle.

14. The underwater breathing apparatus of claim 9, further comprising an air filter means.

15. The underwater breathing apparatus of claim 9, further comprising an air drying means.

16. The underwater breathing apparatus of claim 9, wherein said housing comprises a wet compartment and a dry compartment, said wet compartment being open to ambient water, and said compressor means, said battery means, and said control circuit being contained within said dry section of said housing.

17. An underwater breathing apparatus comprising:

a self-contained power source in electrical communication with a control circuit and a compressor means, the compressor means being coupled to a submersible air intake means and an air storage means, the air storage means being further coupled to a mouthpiece means.

18. The underwater breathing apparatus of claim 17, further comprising a sensor means for detecting when the submersible air intake means is in gas communication with air.

19. The underwater breathing apparatus of claim 18, wherein the compressor means functions only when the submersible air intake means is in gas communication with air.

20. The underwater breathing apparatus of claim 17, wherein the underwater breathing apparatus is wearable.

* * * * *